US007234673B2

(12) United States Patent
Graneto, III

(10) Patent No.: US 7,234,673 B2
(45) Date of Patent: Jun. 26, 2007

(54) WALL MOUNTED BRACKET SYSTEM

(75) Inventor: Joseph A. Graneto, III, Wildwood, MO (US)

(73) Assignee: Salus Corporation, St. Louis, MO (US)

( * ) Notice: Subject to any disclaimer, the term of this patent is extended or adjusted under 35 U.S.C. 154(b) by 57 days.

(21) Appl. No.: 10/836,498

(22) Filed: Apr. 30, 2004

(65) Prior Publication Data

US 2005/0242260 A1 Nov. 3, 2005

(51) Int. Cl.
*A47B 73/00* (2006.01)

(52) U.S. Cl. ..... 248/311.2; 220/751

(58) Field of Classification Search ..... 248/311.2, 248/311.3; 141/86, 87, 88; 403/14, 13; 220/737, 742, 751

See application file for complete search history.

(56) References Cited

U.S. PATENT DOCUMENTS 2,196,356 A * 4/1940 De Sipio et al. ..... 222/162
3,842,981 A * 10/1974 Lambert ..... 211/74
4,132,380 A 1/1979 Pastore
D256,859 S 9/1980 Hauser et al.
4,229,893 A * 10/1980 Uys Naude ..... 40/332
4,271,878 A * 6/1981 Bologa ..... 141/375
4,303,109 A 12/1981 Cohen
4,789,017 A * 12/1988 Panasewicz et al. ..... 141/342
5,356,038 A 10/1994 Banks
D365,509 S 12/1995 Bell et al.
5,897,090 A * 4/1999 Smith et al. ..... 248/311.2
D422,828 S 4/2000 Kanfer et al.
6,581,804 B1 6/2003 Ciavarella et al.
2004/0021048 A1* 2/2004 Schaal ..... 248/310

* cited by examiner

*Primary Examiner*—Amy J. Sterling
*Assistant Examiner*—Steven M. Marsh
(74) *Attorney, Agent, or Firm*—Armstrong Teasdale LLP

(57) ABSTRACT

A container holding unit includes a wall mountable bracket and a drip container bracket. The wall mountable bracket includes a mounting portion, a container holding portion extending from the mounting portion configured to substantially surround a portion of a container while allowing a dispensing tip of a container to pass through, and a plurality of container engaging slats extending inward from the container holding portion. The drip container bracket includes a back section configured to engage the wall mountable bracket and a drip container extending from a bottom of the back section. The drip container further includes a depression formed therein.

13 Claims, 8 Drawing Sheets

WALL MOUNTED BRACKET SYSTEM

BACKGROUND OF THE INVENTION

This invention relates generally to mounting brackets for dispensed products, and more specifically to, a wall mounted bracket with an optional drip container bracket.

As is well known, products are packaged in containers that come in many different types, shapes, and sizes. One product which has increased in use recently is the aerosol-type dispenser for various foams, particularly in the medical field where there are various alcohol-based, anti-bacterial, and anti-microbial foams marketed which reduce the spread of germs, diseases, and the like.

In a particular application, such a container is suspended upside down in a wall bracket, so that a user of such products can easily dispense the product from the container for use in both hands. However, such a dispensing system still has drawbacks. Most known wall brackets are custom made for a specific container size. Further, while certain products utilize various sizes of the same type of container, the wall brackets cannot accommodate more than one size of these containers. In addition, since the products are mounted to the wall in a dispensing top facing down orientation, it is common for excess material to drip on the floor and along the wall between the bracket and the floor.

BRIEF DESCRIPTION OF THE INVENTION

In one aspect, a mountable bracket for holding a container having a dispensing tip in a dispensing tip down orientation is provided. The mountable bracket comprises a mounting portion, a container holding portion extending from the mounting portion configured to substantially surround a portion of a container, and a plurality of container engaging slats extending inward from the container holding portion. The container holding portion comprises an open top and a container top engaging member further forming a bottom opening, the container top engaging member configured to engage a portion of the container inserted from the open top while allowing the dispensing tip of the container to pass through the bottom opening. The container engaging slats allow the mountable bracket to hold a plurality of sizes of container while substantially centering the container within the container holding portion.

In another aspect, a drip container bracket comprising a back section, a drip container, and at least one support molding is provided. The back section is configured to engage a mountable bracket for holding a container and includes a top, a bottom, two sides, and a slot formed therein. The slot extends a length from the top into the back section and is configured to engage a member extending from the mountable bracket. The drip container extends from the bottom of the back section and comprises a depression formed therein and a flat member extending between the depression and the intersection with the bottom of the back. The support molding extends from the side of the back section to the flat member.

In still another aspect, a container holding unit comprising a wall mountable bracket and a drip container bracket is provided. The wall mountable bracket comprises a mounting portion, a container holding portion extending from the mounting portion configured to substantially surround a portion of a container, and a plurality of container engaging slats extending inward from the container holding portion. The drip container bracket comprises a back section configured to engage the wall mountable bracket and a drip container. The back section of the drip container bracket comprises a bottom, and the drip container extends from the bottom of the back section. The drip container comprises a depression formed therein.

DETAILED DESCRIPTION OF THE INVENTION

Figure 1:
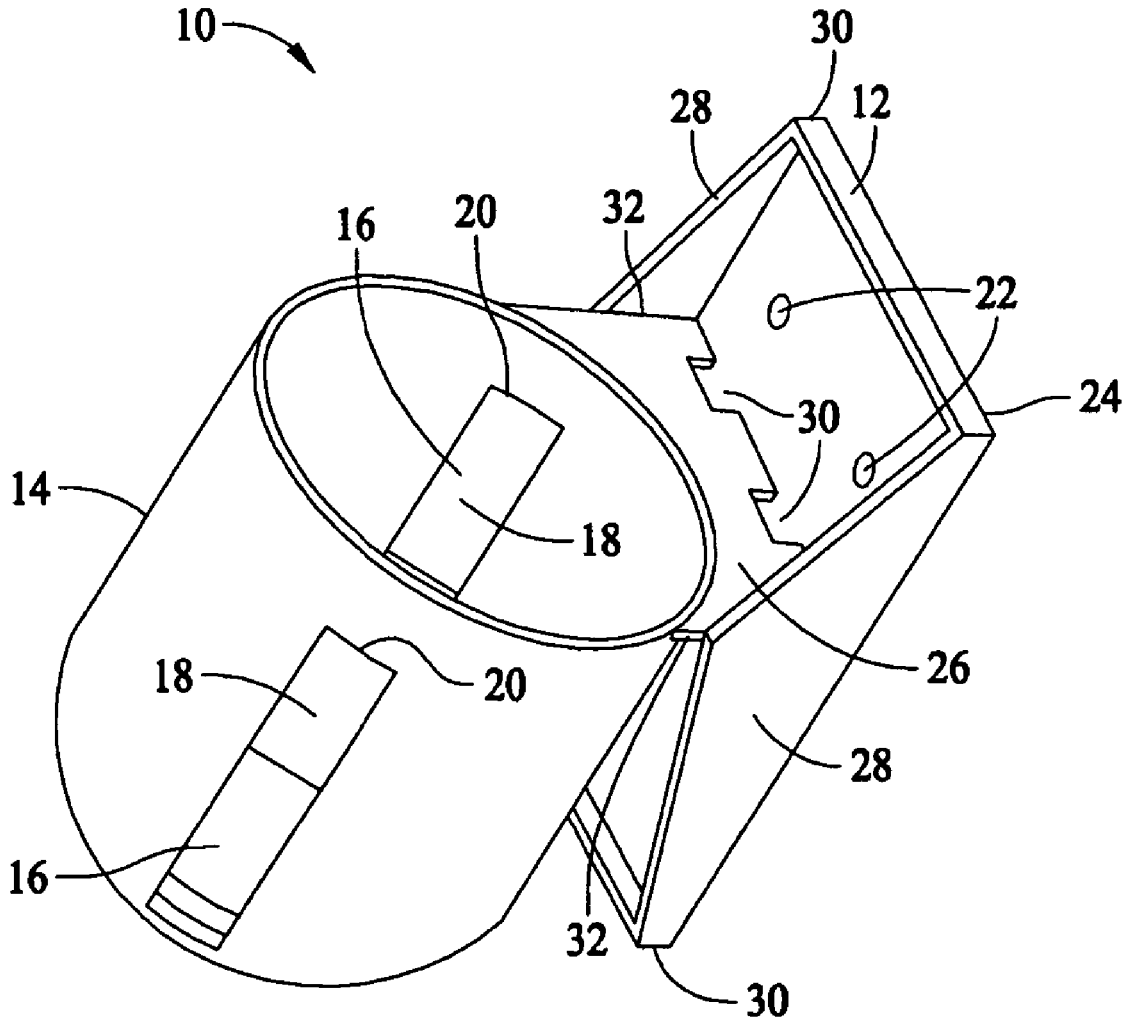
FIG. 1 is a perspective view of a wall mountable bracket.

FIG. 1 is a perspective view of a wall mountable bracket 10 for holding a container. Mountable bracket 10 includes a mounting portion 12 and a container holding portion 14 extending from mounting portion 12. In one embodiment, container holding portion 14 is configured to substantially surround a portion of a container (not shown). In one embodiment, container holding portion 14 is substantially circular and includes a plurality of slots 16 formed therein and container engaging slats 18 extend from a first end 20 of slots 16. As illustrated, container engaging slats 18 extend inward from container holding portion 14, and container engaging slats 18 allow mountable bracket 10 to hold various containers (shown in FIG. 10) which may have a plurality of diameters. To accommodate the plurality of diameters, container engaging slats 18 are flexible, and the connection of container engaging slats 18 with the remainder of container holding portion 14 at first end 20 forms a hinge-like structure. Therefore, container engaging slats 18 provide a friction fit against a container when inserted, and further hold the container in an upright position.

In alternative embodiments, container engaging slats 18 are unitary with container holding portion 14 or are attached to container holding portion 14. In another alternative embodiment, container holding portion 14 does not include slots 16.

Still referring to FIG. 1, mounting portion 12 includes one or more openings 22 formed therein which allows mountable bracket 10 to be attached to a wall or other vertical surface using attachment devices, for example, screws. In alternative embodiments (not shown), mountable bracket 10 includes a hanging mount (not shown) for hanging bracket 10 over a door or on a hanging device, for example. An additional embodiment includes an adhesive on a back of mounting portion 12 for attachment to a surface or hook and loop type fastener affixed to mountable bracket 10 and a mounting surface respectively.

Mounting portion 12 further includes a wall engaging surface 24, an attachment member 26 which extends substantially perpendicularly from wall engaging surface 24 and attaches holding portion 14 and mounting portion 12. Side braces 28 which are triangular and extend from along a side 30 of wall engaging surface 24 and along a length 32 of attachment member 26 provide stability and strength for the attachment of holding portion 14 and mounting portion 12. Two substantially rectangular engaging slots 30 are formed in attachment member 26 at the intersection of attachment member 26 and wall engaging surface 24 for an engagement of a drip container bracket (not shown) as described below.

Figure 2:
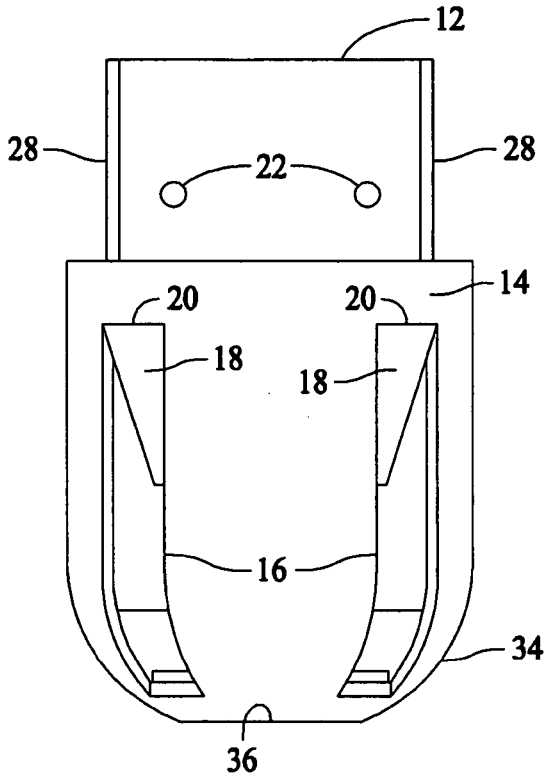
FIG. 2 is a front view of the wall mountable bracket of FIG. 1.

FIG. 2 is a front view of wall mountable bracket 10. Openings 22 are shown in mounting portion 12. FIG. 2 further illustrates engaging slats 18 extending inward from first end 20 of slots 16 to engage various sizes of containers that are configured to be inserted into container holding portion 14. Since engaging slats 18 are flexible, and are connected at first end 20, multiple sizes of containers are positionable within container holding portion 14 such that nozzles of respective containers are easily accessible by a user. Engaging slats 18 extend a partial length of slots 16 and, as described above, are configured to contact a side wall of a container inserted into bracket 10 and substantially center the container within container holding portion 14. Further, container holding portion 14 includes a tapered portion 34 so that an end of a container may engage an interior bottom 36 of container holding portion 14. Slots 16 extend into taped portion 34 in the embodiment shown. Side braces 28 extending from mounting portion 12 are also shown.

Figure 3:
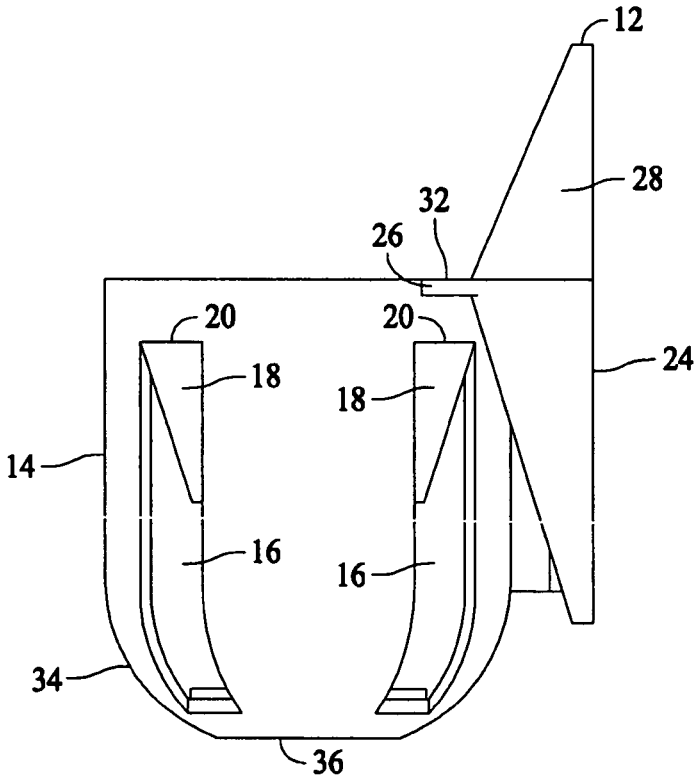
FIG. 3 is a side view of the wall mountable bracket of FIG. 1.

FIG. 3 is a side view of wall mountable bracket 10. The side view further illustrates how mounting portion 12 and container holding portion 14 are connected as side braces 28 extend along a length of attachment member 26 (partially shown). As discerned from the front view of FIG. 2 and the side view of FIG. 3, one specific embodiment of wall mountable bracket 10 includes four slots 16, which are accompanied by the corresponding four engaging slats 18. However, it is contemplated that other embodiments of wall mountable bracket 10 incorporate more or less than four engaging slats 18.

Figure 4:
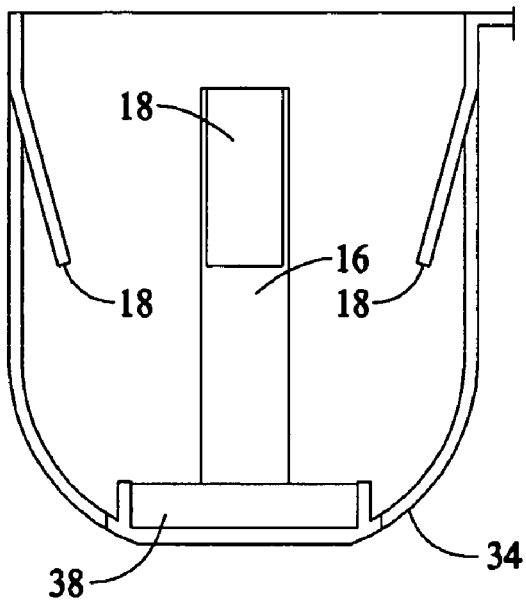
FIG. 4 is a cross-sectional view of a container holding portion of the wall mountable bracket of FIG. 1.

FIG. 4 is a cross-sectional view of container holding portion 14 which better illustrates two of engaging slats 18 and their relative positioning within container holding portion 14. In one embodiment, container holding portion 14 of wall mountable bracket 10 also includes a substantially circular container top engaging member 38 which engages a circular top portion of a container (not shown) when such a container is inserted into container holding portion 14. Container top engaging member 38 also acts as a seating member when a container is inserted into container holding member 14 as such containers are typically tapered at the top. As such, once the diameter of the container is approximately the same as the diameter of container top engaging member 38, the container will be properly inserted into container holding portion 14 of wall mountable bracket 10. Container top engaging member 38 further provides an opening 39 which allows a container to be positioned within container holding portion 14 with its dispensing tip oriented downward. A friction fit of engaging slats 18 with container sides and the contact of container top engaging member 38 with the circular top portion of a container is sufficiently snug so that a container is held in place when a user manipulates a container dispensing tip to release the product within the container.

Figure 5:
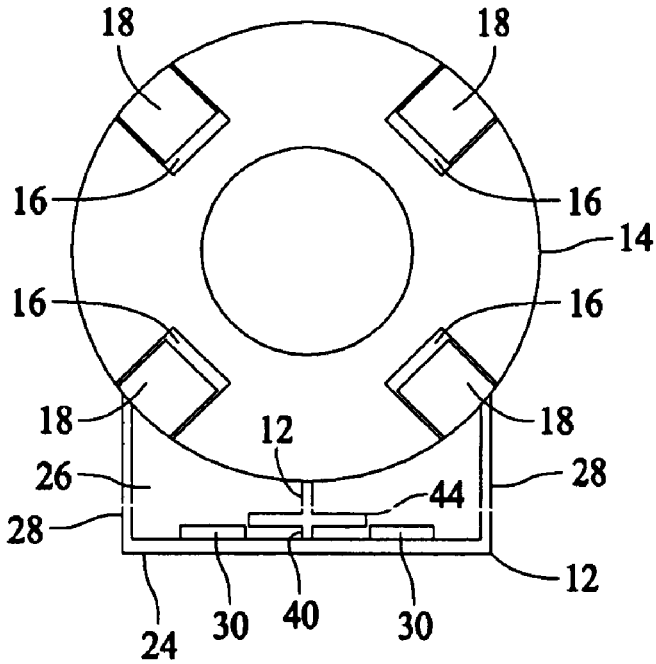
FIG. 5 is a bottom view of the wall mountable bracket of FIG. 1.

FIG. 5 is a bottom view of wall mountable bracket 10 of FIG. 1. A T-shaped member 40 extends from wall engaging surface 24 and is located below attachment member 26. T-shaped member 40 includes a perpendicular portion 42 extending from wall engaging surface 24 and a crossing portion 44 which is a distance from wall engaging surface 24 and substantially perpendicular to wall engaging surface 24. Rectangular engaging slots 30 are also shown as formed in attachment member 26. In one embodiment, T-shaped member 40 engages a slot (not shown) formed in a drip container bracket (not shown) as described below. A vertical alignment of T-shaped member 40, and specifically crossing portion 44, with respect to rectangular slots 30, is utilized to engage and at least partially retain a drip container bracket.

Figure 6:
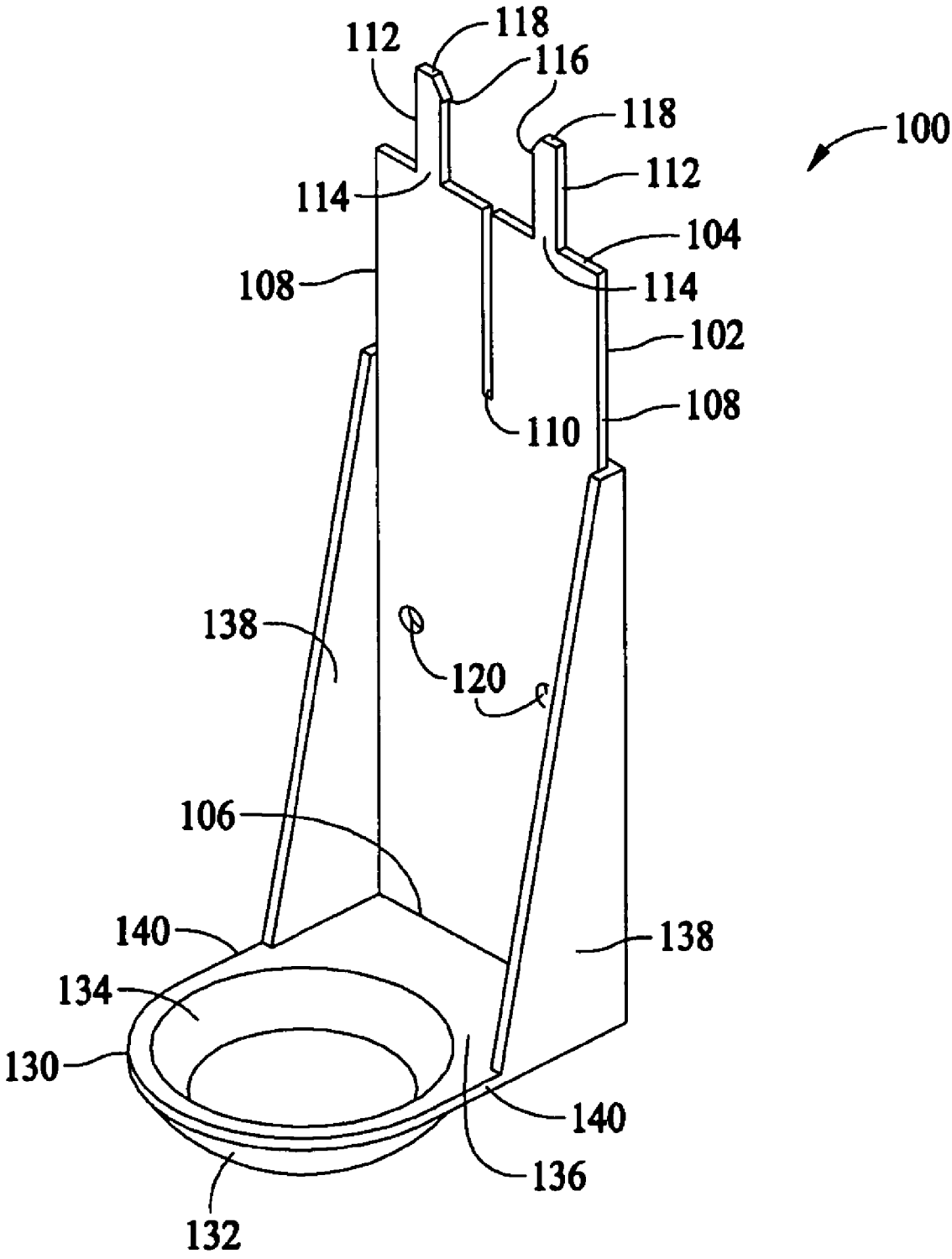
FIG. 6 is a perspective view of a drip container bracket configured to engage the wall mountable bracket of FIG. 1.

FIG. 6 is a perspective view of a drip container bracket 100 configured to engage wall mountable bracket 10 (shown in FIGS. 1–5). Drip container bracket 100 includes a back section 102 configured to engage a mountable bracket for holding a container (e.g., wall mountable bracket 10). Back section 102 includes a top 104, a bottom 106, and two sides 108. In one embodiment, back section 102 further includes a slot 110 formed therein which extends a length from top 104 of back section 102 towards bottom 106. In the embodiment illustrated, back section 102 also includes two clip members 112 extending from top 104. Clip members 112 include a back section engaging end 114 and a tang 116 extending laterally from a second end 118 of clip member 112 that is opposite from back section engaging end 114. In one embodiment, back section 102 includes a number of openings 120 formed therein for mounting drip container bracket 100. Alternative embodiments of drip container bracket may utilize one or more of the attachment mechanisms described above for attaching wall mountable bracket 10.

Still referring to FIG. 6, drip container bracket 100 includes a drip container 130 extending from bottom 106 of back section 102. Drip container 130 includes a container portion 132 having a depression 134 formed therein and a flat member 136 extending between depression 134 and a substantially perpendicular intersection with bottom 106 of back section 102. A substantially triangular support molding 138 extends from each side 108 of back section 102 to a side 140 of flat member 136 to provide stability and strength for the attachment of bottom 106 of back section 102 and container portion 132. In one embodiment, and as illustrated, depression 134 has a frusta-conical shape for catching and retaining excess liquids released from a container inserted into wall mountable bracket 10 (shown in FIGS. 1–5). In an alternative embodiment (not shown), a bottom of depression 134 includes an opening for insertion of a disposable cup or the like for catching and retaining excess liquids.

Figure 7:
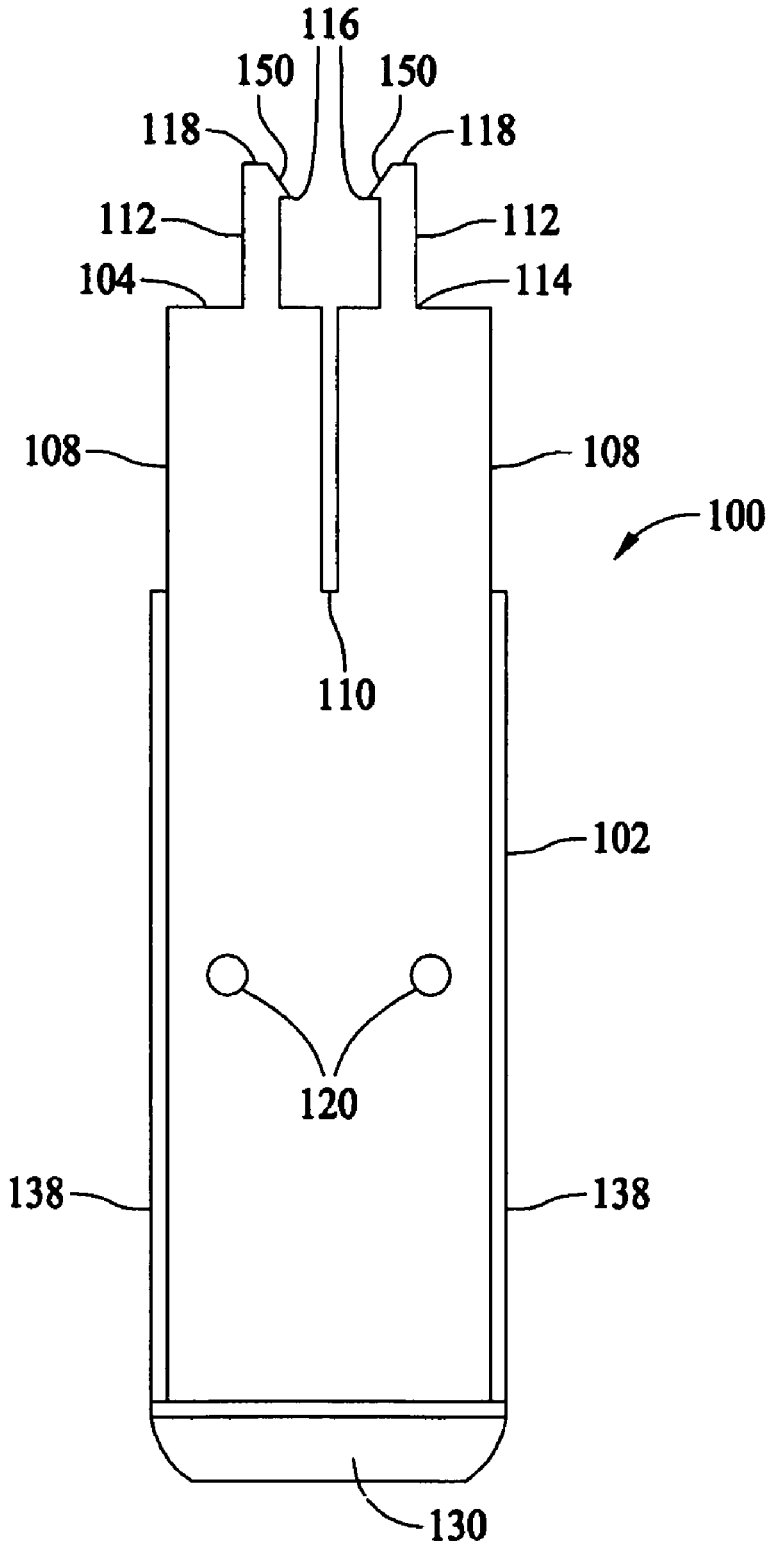
FIG. 7 is a front view of the drip container bracket of FIG. 6.

FIG. 7 is a front view of drip container bracket 100 which better illustrates slot 110 and clip members 112. As illustrated, clip members 112 include tangs 116 extending laterally from second end 118 of clip member 112. In one embodiment, clip members 112 are somewhat flexible, allowing for some lateral movement of second end 118 when clip members 112 are inserted into rectangular slots 30 of wall mountable bracket 10 (shown in FIGS. 1–5). When so inserted, a sloped edge 150 of tang 116 is pressed against rectangular slot 30, when enough force is applied, second ends 118 of clip members 112 spread slightly allowing insertion of drip container bracket 100 until sloped edge 150 passes through rectangular slot 30, at which point, clip members 112 return to their original position with respect to one another, and tangs 116 serve to lock drip container bracket 100 to wall mountable bracket 10.

Figure 8:
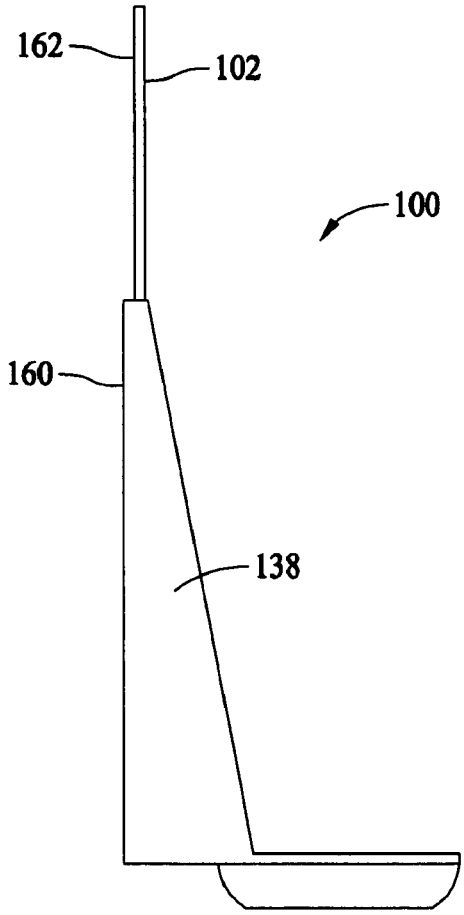
FIG. 8 is a side view of the drip container bracket of FIG. 6.
Figure 9:
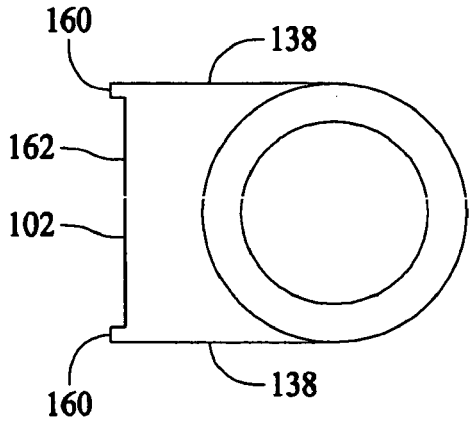
FIG. 9 is a top view of the drip container bracket of FIG. 6.

FIG. 8 is a side view of drip container bracket 100 which illustrates that, in one embodiment, support moldings 138 include an extension 160 that extends slightly beyond a back surface of back section 102. Extensions 160 are further illustrated in FIG. 9, which is a top view of drip container bracket 100. Extensions 160 rest against wall engaging surface 24 (shown in FIG. 1) of wall mountable bracket 10 when drip container bracket 100 is properly engaged with wall mountable bracket 10.

Figure 10:
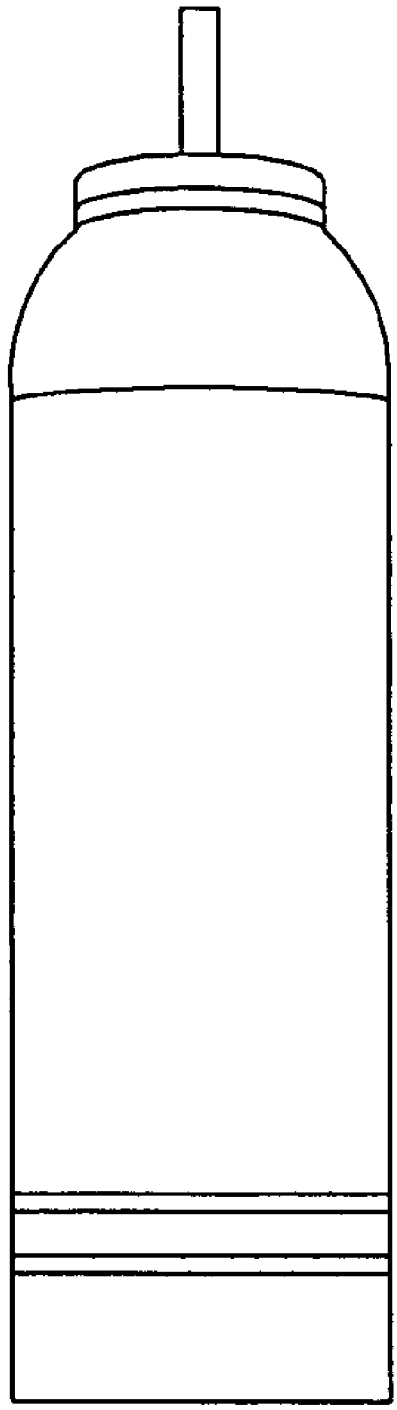
FIG. 10 is an illustration of a container that can be inserted into the wall mountable bracket of FIG. 1.

FIG. 10 is an illustration of an aerosol-type can 200 of product. Together, wall mountable bracket 10 and drip container bracket 100 form a container holding unit configured to engage and hold in place containers similar to aerosol-type can 200 and which also accommodate multiple sizes of the types of products that could utilize such a container holding unit.

Figure 11:
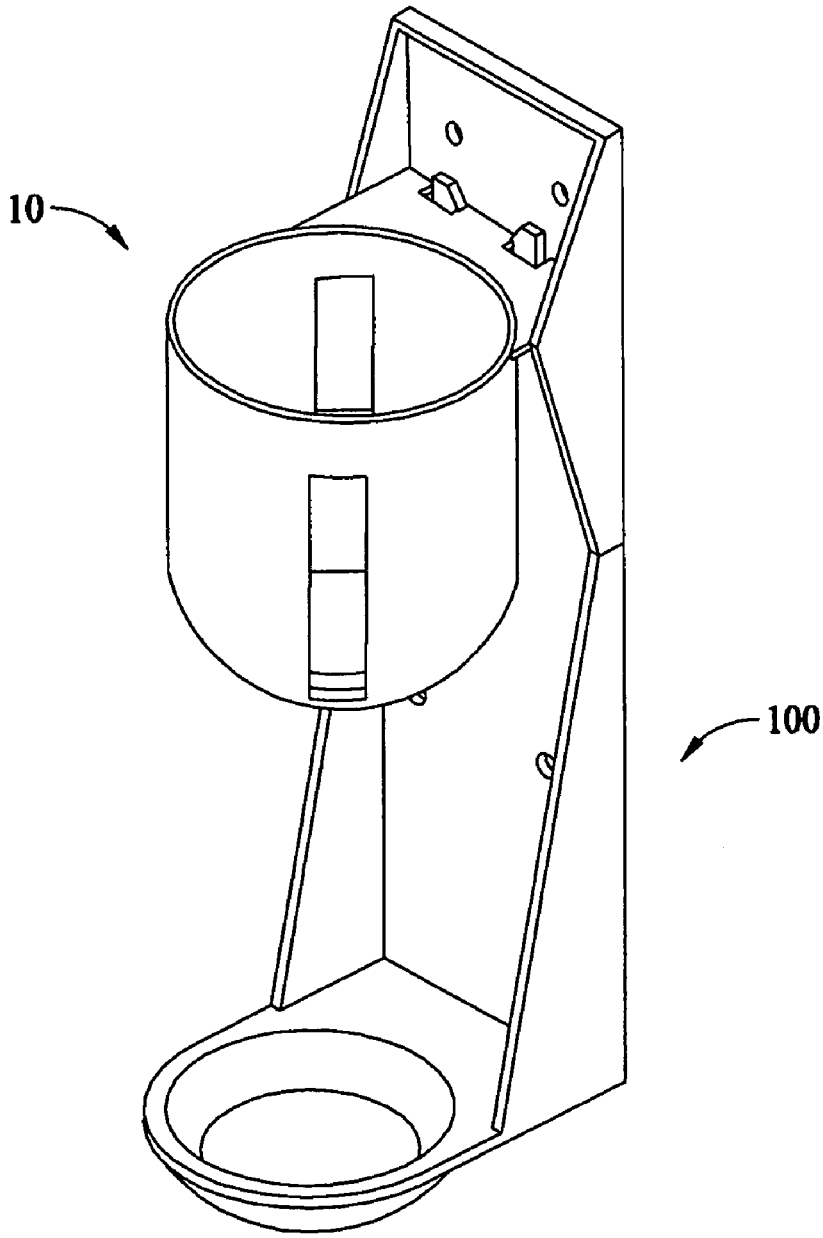
FIG. 11 is a perspective view of a container holding unit including the wall mountable bracket shown in FIG. 1 and the drip container bracket shown in FIG. 6.

FIG. 11 is a perspective view of a container holding unit wherein back section 102 of drip container bracket 100 engages wall mountable bracket 10.

While the invention has been described in terms of various specific embodiments, those skilled in the art will recognize that the invention can be practiced with modification within the spirit and scope of the claims.

What is claimed is:

1. A container holding unit comprising:

a wall mountable bracket comprising a mounting portion, and a container holding portion extending from said mounting portion wherein said container holding portion comprises an opening extending therethrough and is configured to substantially surround a portion of a container, said mounting portion comprising a wall engaging surface and a T-shaped member extending from said wall engaging surface, said container holding portion further comprises a plurality of container engaging slats extending inward from said container holding portion, said container holding portion further comprises an attachment member extending substantially perpendicularly from said wall engaging surface, said attachment member comprising a plurality of rectangular slots formed therein, said slots formed at an intersection of said attachment member and said wall engaging surface; and a drip container bracket comprising a back section configured to engage said wall mountable bracket, said back section comprising a bottom, a top, and a slot formed therein, said slot extending a length from said top, said slot configured to engage said T-shaped member, said back section further comprising a drip container extending from said bottom of said back section, said drip container comprising a depression formed therein, said back section further comprises a plurality of clip members extending from said top of said back, said clip members comprising a back section engaging end, a second end, and a tang extending laterally from said second end of said clip members, said clip members configured for insertion into said rectangular slots formed in said attachment member.

2. The container holding unit according to claim 1 wherein said container holding portion comprises a plurality of slots formed therein, said container engaging slats extending from a first end of said slots and hingably connected to said first end of said slots.

3. The container holding unit according to claim 1 wherein said container holding portion comprises an open top and a container top engaging member further forming a bottom opening, said container top engaging member configured to engage a portion of the container inserted from said open top while allowing a dispensing tip of the container to pass through said bottom opening.

4. The container holding unit according to claim 1 wherein said mounting portion comprises at least one of a wall mount comprising openings formed therein for insertion of an attachment device, a hanging mount, and a mount configured with an adhesive.

5. The container holding unit according to claim 1 wherein said container holding portion is substantially circular.

6. The container holding unit according to claim 1 wherein said engaging slats are configured to engage side walls of the container.

7. The container holding unit according to claim 1 wherein said T-shaped member comprises a perpendicular portion and a crossing portion.

8. The container holding unit according to claim 1 wherein said mounting portion comprises a wall engaging surface, said container holding unit further comprising at least one side brace extending from wall engaging surface to said container holding portion.

9. The container holding unit according to claim 1 wherein said container holding portion comprises an attachment member extending substantially perpendicularly from said wall engaging surface, said container holding unit comprising at least one side brace attached to said attachment member.

10. The container holding unit according to claim 1 wherein said drip container comprises:

a flat member extending between said depression and the intersection with said bottom of said back section; and at least one support molding extending from said side of said back section to said flat member.

11. The container holding unit according to claim 1 wherein said back section of said drip container bracket comprises one or more holes formed therein for mounting on a wall.

12. The container holding unit according to claim 1 wherein said depression of said drip container bracket is frusta-conical.

13. The container holding unit according to claim 1 wherein said depression of said drip container bracket comprises an opening for insertion of a disposable cup.

* * * * *